US011547993B2

(12) United States Patent
Kornilovich et al.

(10) Patent No.: US 11,547,993 B2
(45) Date of Patent: Jan. 10, 2023

(54) DROPLET EJECTORS WITH TARGET MEDIA

(71) Applicant: HEWLETT-PACKARD DEVELOPMENT COMPANY, L.P., Spring, TX (US)

(72) Inventors: Pavel Kornilovich, Corvallis, OR (US); John Lahmann, Corvallis, OR (US); Alexander Govyadinov, Corvallis, OR (US); Diane R Hammerstad, Corvallis, OR (US)

(73) Assignee: Hewlett-Packard Development Company, L.P., Spring, TX (US)

( * ) Notice: Subject to any disclaimer, the term of this patent is extended or adjusted under 35 U.S.C. 154(b) by 69 days.

(21) Appl. No.: 16/608,289

(22) PCT Filed: Jul. 17, 2018

(86) PCT No.: PCT/US2018/042408
§ 371 (c)(1),
(2) Date: Oct. 25, 2019

(87) PCT Pub. No.: WO2020/018073
PCT Pub. Date: Jan. 23, 2020

(65) Prior Publication Data
US 2021/0331152 A1 Oct. 28, 2021

(51) Int. Cl.
*B41J 2/14* (2006.01)
*B41J 2/175* (2006.01)
(Continued)

(52) U.S. Cl.
CPC ..... *B01L 3/0268* (2013.01); *B41J 2/14* (2013.01); *B41J 2/17513* (2013.01); *B41J 2/04526* (2013.01)

(58) Field of Classification Search
CPC ..... B41J 2/04526; B41J 2/14; B41J 2/14016; B41J 2/14145; B41J 2/1433;
(Continued)

(56) References Cited

U.S. PATENT DOCUMENTS 4,329,698 A 5/1982 Smith
4,614,953 A 9/1986 Lapeyre
(Continued)

FOREIGN PATENT DOCUMENTS

CA 2970491 A1 6/2016
EP 0470202 B1 6/1994
(Continued)

OTHER PUBLICATIONS

D. Wallace et al. "Ink-Jet as a MEMS Manufacturing Tool"; Micro Fab Technologies.
(Continued)

*Primary Examiner* — Anh T Vo
(74) *Attorney, Agent, or Firm* — Foley & Lardner LLP

(57) ABSTRACT

An example device includes a droplet ejector including a nozzle to eject droplets of a fluid and a target medium to receive the droplets of the fluid. The target medium is separated from the droplet ejector by a gap to be traversed by the droplets. The example device further includes a frame affixing the target medium to the droplet ejector. The target medium is immovably held with respect to the droplet ejector.

19 Claims, 7 Drawing Sheets

(51) Int. Cl.
*B01L 3/02* (2006.01)
*B41J 2/045* (2006.01)

(58) Field of Classification Search
CPC .. B41J 2/17513; B41J 2/1753; B41J 2/17546; B41J 2/17553; B01L 3/0268
See application file for complete search history.

(56) References Cited

U.S. PATENT DOCUMENTS

| | | | |
|---|---|---|---|
| 4,877,745 | A | 10/1989 | Hayes et al. |
| 5,032,850 | A | 7/1991 | Andeen et al. |
| 5,587,128 | A | 12/1996 | Wilding et al. |
| 5,892,524 | A | 4/1999 | Silverbrook |
| 6,432,694 | B1 | 8/2002 | Malmqvist |
| 6,450,775 | B1 | 9/2002 | Hutchinson et al. |
| 6,464,336 | B1 | 10/2002 | Sharma |
| 6,550,892 | B1 | 4/2003 | Sharma |
| 7,125,447 | B2 | 10/2006 | Sugita et al. |
| 7,179,423 | B2 | 2/2007 | Bohm et al. |
| 7,456,012 | B2 | 11/2008 | Ryttsen et al. |
| 7,763,453 | B2 | 7/2010 | Clemmens et al. |
| 8,158,083 | B2 | 4/2012 | Krug et al. |
| 8,287,112 | B2 | 10/2012 | Thillo et al. |
| 8,308,339 | B2 | 11/2012 | Karpetsky et al. |
| 8,426,209 | B2 | 4/2013 | Butler et al. |
| 8,697,009 | B2 | 4/2014 | Saltsman et al. |
| 8,746,285 | B2 | 6/2014 | Hong et al. |
| 8,894,761 | B2 | 11/2014 | Birecki et al. |
| 9,138,714 | B2 | 9/2015 | Samper et al. |
| 9,410,977 | B2 | 8/2016 | Stone et al. |
| 9,523,013 | B2 | 12/2016 | Reboa |
| 9,663,819 | B2 | 5/2017 | Jovanovich et al. |
| 2001/0016322 | A1 | 8/2001 | Caren et al. |
| 2002/0092767 | A1 | 7/2002 | Bjornson et al. |
| 2002/0127736 | A1 | 9/2002 | Chou et al. |
| 2002/0153251 | A1 | 10/2002 | Sassi et al. |
| 2003/0180449 | A1 | 9/2003 | Wiktorowicz et al. |
| 2005/0106066 | A1 | 5/2005 | Saltsman et al. |
| 2006/0244799 | A1 | 11/2006 | Sasa et al. |
| 2007/0035579 | A1 | 2/2007 | Bibl et al. |
| 2007/0052759 | A1* | 3/2007 | Park ..... B41J 2/14145 347/61 |
| 2007/0111303 | A1 | 5/2007 | Inoue et al. |
| 2008/0114225 | A1 | 5/2008 | Rabinovitz |
| 2008/0136862 | A1 | 6/2008 | Kawabe et al. |
| 2008/0252679 | A1 | 10/2008 | Pierik et al. |
| 2009/0130745 | A1 | 5/2009 | Williams et al. |
| 2009/0148933 | A1 | 6/2009 | Battrell et al. |
| 2009/0278895 | A1* | 11/2009 | Kamito ..... B41J 2/1612 347/54 |
| 2010/0143905 | A1 | 6/2010 | Lane et al. |
| 2010/0214383 | A1 | 8/2010 | Silverbrook et al. |
| 2011/0064613 | A1 | 3/2011 | Chen |
| 2011/0143968 | A1 | 6/2011 | Chen et al. |
| 2012/0113197 | A1* | 5/2012 | Kashu ..... B41J 2/1433 347/89 |
| 2012/0115738 | A1 | 5/2012 | Zhou et al. |
| 2014/0051604 | A1 | 2/2014 | Davies et al. |
| 2015/0273470 | A1 | 10/2015 | Hoffmann |
| 2015/0298119 | A1 | 10/2015 | Williams et al. |
| 2016/0045914 | A1 | 2/2016 | Abate et al. |
| 2016/0175864 | A1 | 6/2016 | Bloc |
| 2016/0341337 | A1 | 11/2016 | Govyadinov et al. |
| 2017/0021620 | A1 | 1/2017 | Oikawa et al. |
| 2017/0165972 | A1 | 6/2017 | Lee |
| 2017/0205438 | A1 | 7/2017 | Peters |
| 2017/0246867 | A1 | 8/2017 | Govyadinov et al. |
| 2018/0015473 | A1 | 1/2018 | Bharadwaj et al. |
| 2018/0017175 | A1 | 1/2018 | Liang et al. |
| 2018/0030515 | A1 | 2/2018 | Regev et al. |
| 2018/0052082 | A1 | 2/2018 | Groll et al. |
| 2020/0207112 | A1 | 7/2020 | Yamanaka et al. |
| 2020/0216840 | A1 | 7/2020 | Tanno et al. |
| 2021/0008890 | A1 | 1/2021 | Bhatt et al. |
| 2021/0046754 | A1 | 2/2021 | Ungerer et al. |
| 2021/0331482 | A1 | 10/2021 | Govyadinov et al. |

FOREIGN PATENT DOCUMENTS

| | | | |
|---|---|---|---|
| EP | 0990525 | B1 | 8/2006 |
| JP | 5007016 | B2 | 8/2012 |
| KR | 20110035113 | A | 4/2011 |
| WO | WO1997011133 | A1 | 3/1997 |
| WO | WO2008024319 | A2 | 2/2008 |
| WO | WO2011094577 | A3 | 11/2011 |
| WO | WO2013135878 | A1 | 9/2013 |
| WO | WO2013176767 | A1 | 11/2013 |
| WO | WO2016175864 | A1 | 11/2016 |
| WO | WO2017091213 | A1 | 6/2017 |
| WO | WO2017180660 | A1 | 10/2017 |

OTHER PUBLICATIONS

Li Baoqing et al., "Piezoelectric-driven droplet impact printing with an interchangeable microfluidic cartridge", Sep. 1, 2015, Biomicrofluidics 9, 054101.

Liu Robin et al., Self-contained, fully integrated biochip for sample preparation, Polymerase Chain Reaction Amplification, and DNA Microarray Detection, Feb. 25, 2004, Analitical Chemistry.

Ly et al.Automated Reagent-Dispensing System for Microfluidic Cell Biology Assays; Dept of Bioengineering, Samueli School of Engineering & Sciences, University of California, Los Angeles, CA, USA, Crump Institute for Molecular Imaging, University of California Los Angeles, CA, USA.

Perch-Nielsen R. Ivan et al., A total integrated biochip system for detection of SNP in Cancer, Jan. 11-14, 2010, Proceedings of the 3rd International Conference on the development of BME.

Rocker Scientific Co. Ltd.; Rocker products; Filtration apparatus/VF11 product sheet.

Tian Qingchang et al., An integrated temporary negative pressure assisted microfluidic chip for DNA isolation and digital PCR detection, Sep. 14, 2015, RSC Advances.

Welch David et al., Real-time feedback control of pH within microfluidics using integrated sensing and actuation, Jan. 23, 2014, Lab on Chip.

Xu et al. A self-contained polymeric cartridge for automated biological sample preparation; Institute of Bioengineering and Nanotechnology, 31 Biopolis Way, The Nanos, Singapore 138669.

Zheng et al. Micro-reagent Dispensing Method Based on Pulse Driving & Controlling of Micro-fluids Technology and Application Research; School of Mechanical Engineering, Nanjing University of Science and Technology, Nanjing 210094, China.

Zhou Hongbo et al., "A facile on-demand droplet microfluidic system for lab-on-a-chip applications", Microfluid Nanofluid 2014 16:667-675.

* cited by examiner

DROPLET EJECTORS WITH TARGET MEDIA

BACKGROUND

Droplet ejection is used for a variety of purposes, such as printing ink to paper and dispensing of other types of fluid to a surface. In many applications, a printhead is attached to a scanning mechanism, and a control system controls the scanning mechanism to move the printhead, in one or two dimensions relative to a two-dimensional target surface, so that the printhead may eject droplets of fluid at different locations on the target surface. It is also common for the target surface to be moved. For example, in an inkjet printer, a scanning mechanism may move the printhead across the width of a page while the page is advanced in the direction of its length.

DETAILED DESCRIPTION

Inkjet-like droplet ejection may be used to deliver biological, chemical, or biochemical materials to target media, which may be passive (e.g., paper) or active (e.g., a silicon die). A droplet ejector may be restrained from movement relative to a target medium, rather than moving a printhead carrying the droplet ejector relative to the target medium. A printhead scanning mechanism and related control system may be omitted. The target medium need not be moved relative to the droplet ejector.

A funnel or other enclosure may be provided between a substrate that carries the droplet ejector and a target medium. A flow rate of the fluid may be precisely controlled via control of the droplet ejector. Droplets and coalesced liquid flow may be directed to a target region by the funnel rather than by relative movement of a printhead and a target medium.

The droplet ejector and the target medium may be combined in a one-time-use or consumable package. The lack of a printhead scanning mechanism and related control system may reduce the complexity of implementing such a disposable device.

Any number of droplet ejectors and target media may be used. Flow may be increased by using more droplet ejectors. Different reactions may be simultaneously performed with different target media. In addition, different droplets may be used to create different reactions on the same target medium.

Figure 1:
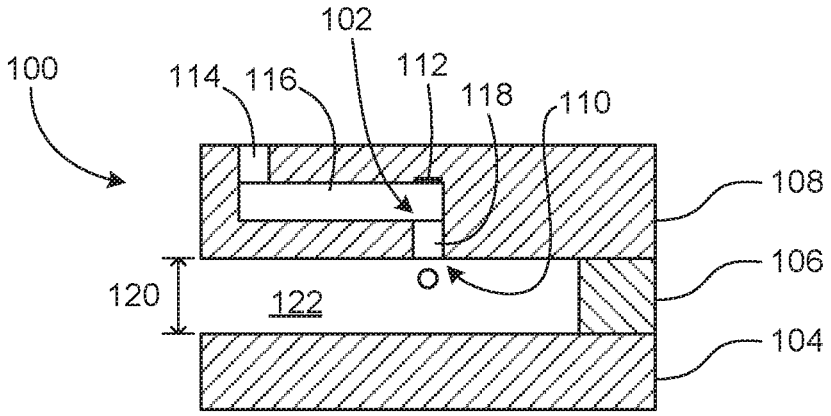
FIG. 1 is a cross-sectional view of an example device with a frame affixing a target medium to a droplet ejector.

FIG. 1 shows an example device 100. The device 100 includes a droplet ejector 102, a target medium 104, and a frame 106.

The droplet ejector 102 may be formed at a substrate 108 and such a substrate may have multiple layers. The substrate 108 may include silicon, glass, photoresist, and similar materials. The droplet ejector 102 includes a nozzle 110 to eject droplets of a fluid towards the target medium 104.

The droplet ejector 102 may include a jet element 112, such as a resistive heater, a piezoelectric element, or similar. The jet element 112 is controllable to draw fluid from an inlet 114 and through a channel 116 that feeds the ejector 102, so as to jet fluid droplets through an orifice 118. Any number of droplet ejectors 102 may be provided to a head, which may be referred to as a reagent dispenser or consumable, and such a device may employ inkjet droplet jetting techniques, such as thermal inkjet (TIJ) jetting.

The fluid provided to the droplet ejector 102 may be a reagent, such as a chemical solution, a sample (e.g., a deoxyribonucleic acid or DNA sample), or other material. The term "fluid" is used herein to denote a material that may be jetted, such as aqueous solutions, suspensions, solvent solutions (e.g., alcohol-based solvent solutions), oil-based solutions, or other materials.

The target medium 104 is positioned to receive droplets of the fluid from the droplet ejector 102. The target medium is separated from the droplet ejector 102 by a gap 120 to be traversed by the droplets. A volume 122 exists between the substrate 108 that carries the droplet ejector 102 and the target medium 104.

The target medium 104 may be provided with a reagent, sample, or similar material to undergo a biological, chemical, or biochemical process with a reagent, sample, or similar material provided by droplets ejected by the droplet ejector 102.

The target medium 104 may include a passive medium. Examples of passive target media include a strip or other structure of porous material, paper, foam, fibrous material, micro-fibers, and similar. A passive target medium may include a network of microfluidic channels, which may be made of silicon, photoresist (e.g., SU-8), polydimethylsiloxane (PDMS), cyclic olefin copolymer (COC), other plastics, glass, and other materials that may be made using micro-fabrication technologies. Fluid deposited by droplets ejected by the droplet ejector 102 may be conveyed by capillary action by a passive target medium. In other examples, a passive target medium may be non-porous. A passive medium may contain a fluid that receives droplets of ejected fluid. That is, droplets of an ejected fluid may be ejected into another fluid that is contained by a passive medium. Similarly, a passive medium may contain a solid compound that receives droplets of ejected fluid. A solid compound may be solid in bulk, may be a powder or particulate, may be integrated into a fibrous material, or similar.

The target medium 104 may include an active medium. Examples of active target media include a substrate having a mesofluidic or microfluidic structure. An active target medium may include an active microfluidic component, such as a pump, sensor, mixing chamber, channel, heater, reaction chamber, droplet ejector, or similar to perform further action on fluid delivered by droplets ejected by the droplet ejector 102.

The frame 106 affixes the target medium 104 to the substrate 108 that carries the droplet ejector 102. As such, the target medium 104 is immovably held with respect to the droplet ejector 102. The droplet ejector 102, target medium 104, and frame 106 may be integrated together as a disposable cartridge having a unitary package, which may be disposed after use. The droplet ejector 102, target medium 104, and frame 106 may be permanently held together by adhesive, material deposition (e.g., deposition of photoresist onto a silicon substrate), an interference or snap fit, overmolding of the frame 106 to the droplet ejector 102 and/or target medium 104, or similar technique. The frame 106 may enclose the volume 122 between the substrate 108 and the target medium 104.

The frame 106 affixing the target medium 104 to the substrate 108 that carries the droplet ejector 102 prevents relative motion of the target medium 104 and the droplet ejector 102 and eliminates the need for a scanning mechanism and related control system or similar mechanism.

In operation, the droplet ejector 102 may be controlled to eject droplets of fluid at a rate, which may be varied over time, to deliver fluid to the target medium 104. A reaction or other process at the target medium 104 is performed using the fluid provided by the droplet ejector 102 and any other material provided to the target medium 104.

For example, the fluid provided to the droplet ejector 102 may be a purified DNA sample mixed with a master mix reconstitution buffer. The target medium 104 may include a silicon die having a pre-dried master mix. As the sample and buffer mixture is delivered by the droplet ejector 102, the master mix is reconstituted and a heater embedded in the target medium 104 may be cycled to perform a polymerase chain reaction (PCR).

Other example applications of the device 100 include a real-time or quantitative polymerase chain reaction (qPCR), reverse transcription polymerase chain reaction (RT-PCR), loop mediated isothermal amplification (LAMP), and similar.

Figure 2:
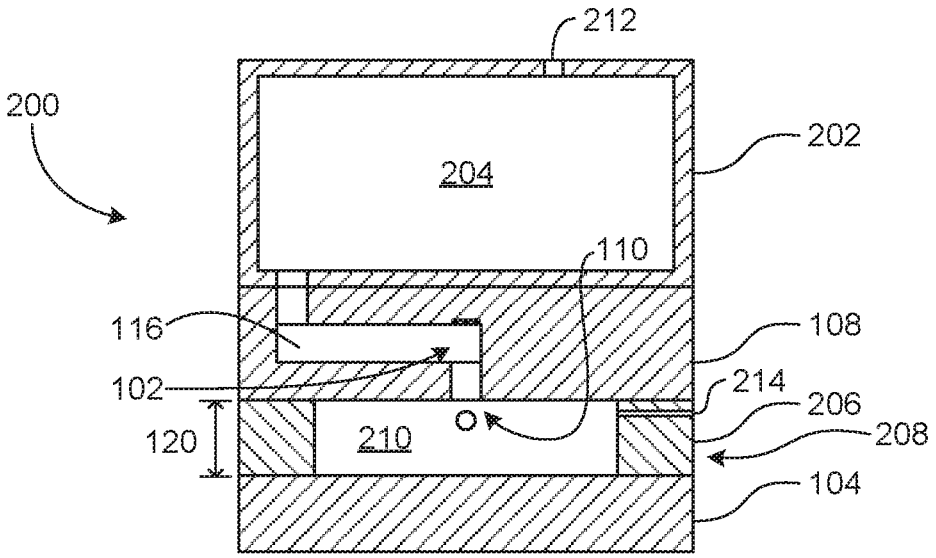
FIG. 2 is a cross-sectional view of an example device with an enclosure affixing a target medium to a droplet ejector.

FIG. 2 shows an example device 200. Features and aspects of the other devices and systems described herein may be used with the device 200 and vice versa. Like reference numerals denote like elements and description of like elements is not repeated here.

The device 200 may include a fluid reservoir 202 defining a fluid volume 204 to supply the fluid to a droplet ejector 102. The fluid reservoir 202 may include an end region of a slot in a substrate 108 that carries the droplet ejector 102, and such a slot may convey fluid from a user-fillable or factory-finable reservoir, fill cup, or similar volume to the channel 116 of the droplet ejector 102.

The device 200 may be preloaded with the fluid to be ejected by the droplet ejector 102. That is, the fluid volume 204 may be filled at time of manufacture or otherwise before use of the device 200. As such, the device 200 may be a ready-to-use consumable device.

The device 200 may include a frame 206 that affixes a target medium 104 to the substrate 108 that carries the droplet ejector 102. The frame 206 may be similar to the other frames described herein.

The frame 206 may be shaped to define an enclosure 208 that defines an internal droplet volume 210 to contain the fluid droplets ejected by the droplet ejector 102 as the droplets traverse the gap 120 between the nozzle 110 of the droplet ejector 102 and the target medium 104. The enclosure 208 may reduce a risk of intrusion of contaminants and may increase reliability of ejected fluid reaching the target medium 104. The enclosure 208 may be rectangular, as depicted, or may take another geometry.

The fluid reservoir 202 may include a vent 212 to allow outside air or other gas to enter the fluid reservoir 202 as fluid is ejected, so as to relieve negative pressure that may be caused by fluid being drawn from the fluid reservoir 202. The vent 212 may include an opening, a permeable membrane, a bubbler, or similar structure that may resist the intrusion of outside contaminants while allowing for pressure equalization.

The frame 206 may include a vent 214 to relieve positive pressure that may develop due to fluid being ejected into the internal droplet volume 210. The vent 214 of the frame 206 may be similar or identical in structure to the vent 212 of the fluid reservoir 202.

In other examples, a plurality of fluid reservoirs 202 may be provided to a plurality of droplet ejectors 102 that may be arranged to provide droplets of different fluids to the internal droplet volume 210. Examples of arrangements of droplet ejectors 102 are discussed in detail below.

Figure 3:
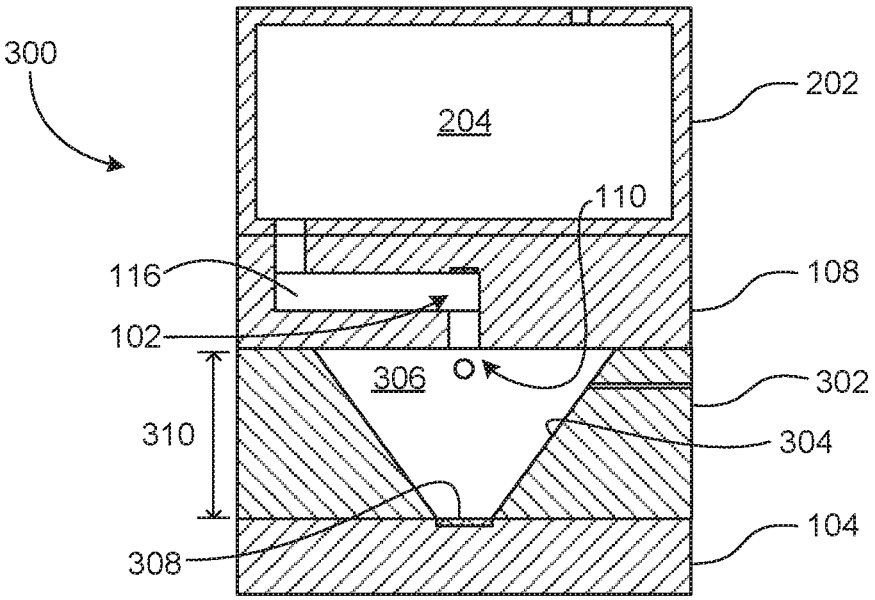
FIG. 3 is a cross-sectional view of an example device with an example funnel between a target medium and a droplet ejector.

FIG. 3 shows an example device 300. Features and aspects of the other devices and systems described herein may be used with the device 300 and vice versa. Like reference numerals denote like elements and description of like elements is not repeated here.

The device 300 includes a funnel 302 disposed between a nozzle 110 of a droplet ejector 102 and a target medium 104.

The funnel 302 may act as a frame that affixes the target medium 104 to a substrate 108 that carries the droplet ejector 102. The funnel 302 may hold the target medium 104 and the droplet ejector 102 immovable with respect to one another.

The funnel 302 may include an internal funnel surface 304 that defines an internal droplet volume 306 to contain the fluid droplets ejected by the droplet ejector 102. In the view shown, two opposing funnel surfaces 304 are depicted. The funnel surface 304 may be flat or curved and may generally narrow from the substrate 108 towards the target medium 104. The funnel surface 304 may guide droplets in flight, whether liquid droplets or aerosol, and coalesced droplets/aerosol as liquid towards a target region 308 on the target medium 104. In some examples, larger liquid droplets are ejected directly onto the target region 308 while aerosol coalesces on the funnel surface 304 to create liquid that flows to the target region 308.

The funnel 302 may define an internal droplet volume 306 that is to contain droplets ejected by the droplet ejector 102 as the droplets traverse a gap 310 between the nozzle 110 of the droplet ejector 102 and the target medium 104. The funnel 302 may enclose the internal droplet volume 306, which may reduce a risk of intrusion of contaminants and increase reliability of ejected fluid reaching the target region 308.

Opposing internal funnel surfaces 304 may narrow along the length of the gap 310. This may be particularly useful when ejecting droplets of different volumes. Additionally, a target region 308 may reside at different distances from the droplet ejectors 102, and thus the funnel 302 may be suitably shaped in the direction of the gap 310. The funnel may or may not be symmetrical.

The funnel 302 may be particularly useful in collecting droplets ejected by a plurality of droplet ejectors 102 that may be arranged in an array, grid, or other arrangement and therefore may not be aimed directly towards the target region 308 on the target medium 104. Examples of such arrangements are described elsewhere herein with respect to an XY plane.

Figure 4:
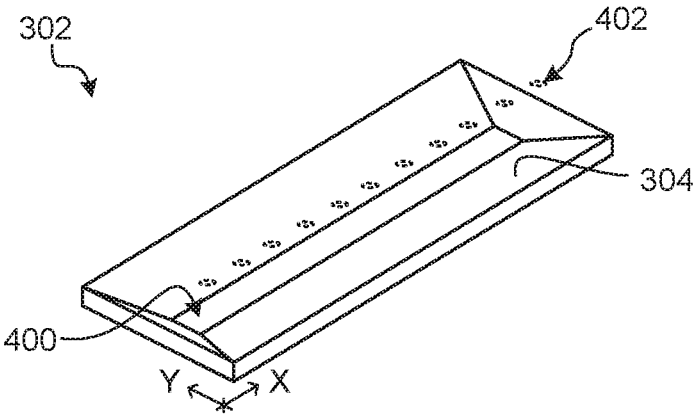
FIG. 4 is a perspective view of the funnel of FIG. 3 showing a linear arrangement of droplet ejector nozzles.

FIG. 4 shows a perspective view of the funnel 302. In this example, the funnel 302 includes four planar surfaces 304 that narrow to a funnel outlet 400 that may be located at a target region of a target medium. In other examples, other surface geometry may be used, such as a curved surface.

A linear arrangement 402 of droplet ejector nozzles is shown schematically. Such a linear arrangement 402 includes the nozzle 110 of FIG. 3 and extends perpendicular to the page in the view of FIG. 3. Droplets that do not directly traverse from the ejectors to the funnel outlet 400 may coalesce on a surface 304 and then flow as a liquid towards the outlet 400. The funnel outlet 400 may be large enough such that a plurality of droplet ejectors is able to eject directly onto a target medium.

For a given geometry of the funnel 302, the pitch or spacing of the linear arrangement 402 of droplet ejectors may be selected to provide a number of droplet ejectors to provide a target maximum flow rate. An example nozzle center-to-center spacing of droplet ejectors is within a range of 15-100 microns.

Figure 5:
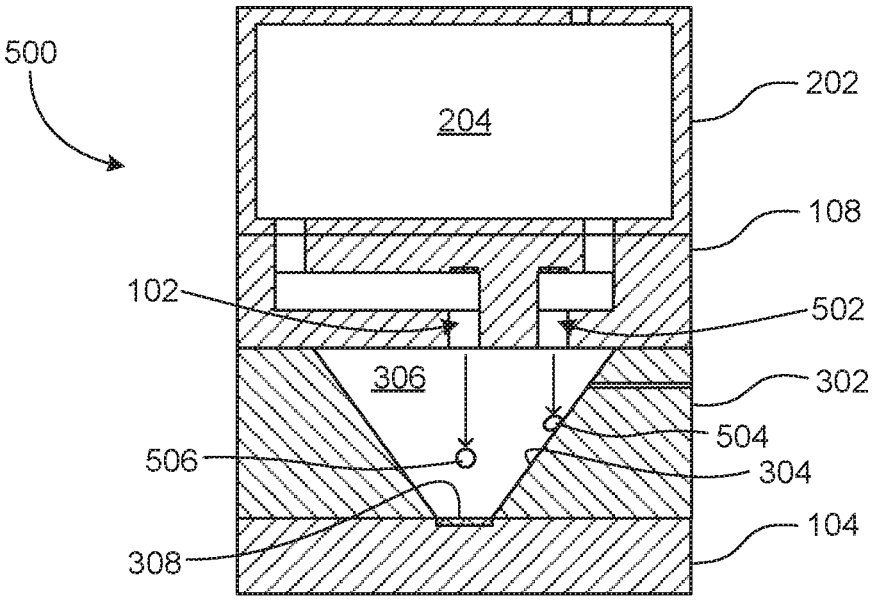
FIG. 5 is a cross-sectional view of an example device with an example funnel between a target medium and a plurality of droplet ejectors.

FIG. 5 shows an example device 500. Features and aspects of the other devices and systems described herein may be used with the device 500 and vice versa. Like reference numerals denote like elements and description of like elements is not repeated here.

The device 500 includes a plurality of droplet ejectors 102, 502. The different droplet ejectors 102, 502 may be provided with fluid by the same fluid reservoir 202.

A first droplet ejector 502 is positioned with respect to a funnel 302, so that ejected droplets 504 tend to directly impinge on a funnel surface 304. That is, the droplet ejector 502 is aimed at the funnel surface 304. Droplets 504 ejected by the droplet ejector 502 may coalesce on the funnel surface 304 to create a liquid. Flow of such liquid may be guided by the funnel 302 to a target region 308 on a target medium 104.

A second droplet ejector 102 is positioned with respect to the funnel 302, so that droplets 506 are ejected directly towards the target region 308 of the target medium 104. That is, the droplet ejector 102 is aimed at the target region 308. The second droplet ejector 102 provides a direct flight path to the target region 308. To the extent that droplets 506 ejected by the second droplet ejector 102 impinge the funnel surface 304, such droplets 506 may coalesce on the funnel surface 304 to create a flowable liquid.

Figure 6:
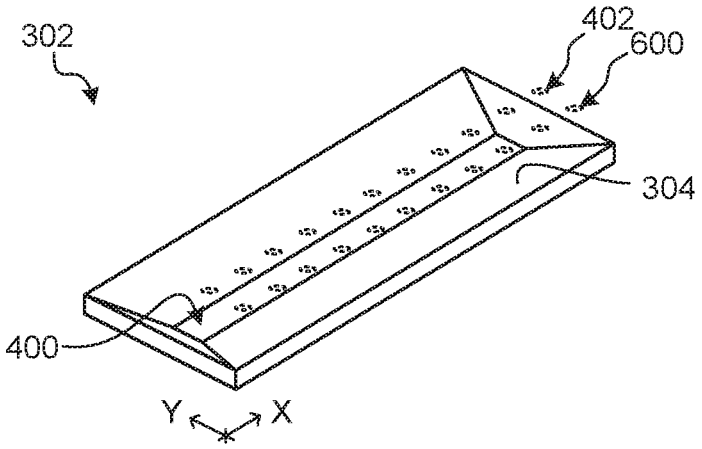
FIG. 6 is a perspective view of the funnel of FIG. 5 showing a plurality of linear arrangements of droplet ejector nozzles.

FIG. 6 shows a perspective view of the funnel 302 with a plurality of linear arrangements 600, 402 of droplet ejector nozzles. A first linear arrangement 600 may be positioned corresponding to the first droplet ejector 502 of FIG. 5 and a second linear arrangement 402 may be positioned corresponding to the second droplet ejector 102 of FIG. 5. The linear arrangements 600, 402 may form a two-dimensional array, grid, or other structure that may lie within an XY plane. The funnel 302 may this be used to collect and guide fluid ejected from a plurality of ejectors that are not necessarily aimed directly at a target region of a target medium.

The linear arrangements 600, 402 of droplet ejector nozzles may be situated in an XY plane defined by the substrate in which the droplet ejectors are formed. A pitch of droplet ejectors in either or both the X and Y directions may be limited by manufacturing constraints. In other examples, a plurality of droplet ejectors may be arranged in a nonlinear pattern, such as an arc that lies within an XY plane. A target maximum flow rate of fluid for a device as a whole may be achieved by increasing a number of droplet ejectors and decreasing ejector spacing to an extent possible. Each droplet ejector may have its own maximum flow rate for a given fluid and a total flow capacity may be determined by summing the individual maximum flow rates for a plurality of ejectors.

Any combination of droplet ejector pitch, spacing, or pattern, number of droplet ejectors, and funnel geometry may be selected to obtain a target maximum flow rate. A flow rate lower than maximum may be achieved by modulating droplet ejector output. A droplet ejector may have its output frequency controlled to achieve a target rate. A droplet ejector may be turned off to reduce a total output rate of a plurality of droplet ejectors. Likewise, a droplet ejector may be turned on to increase a total output rate of a plurality of droplet ejectors.

Figure 7:
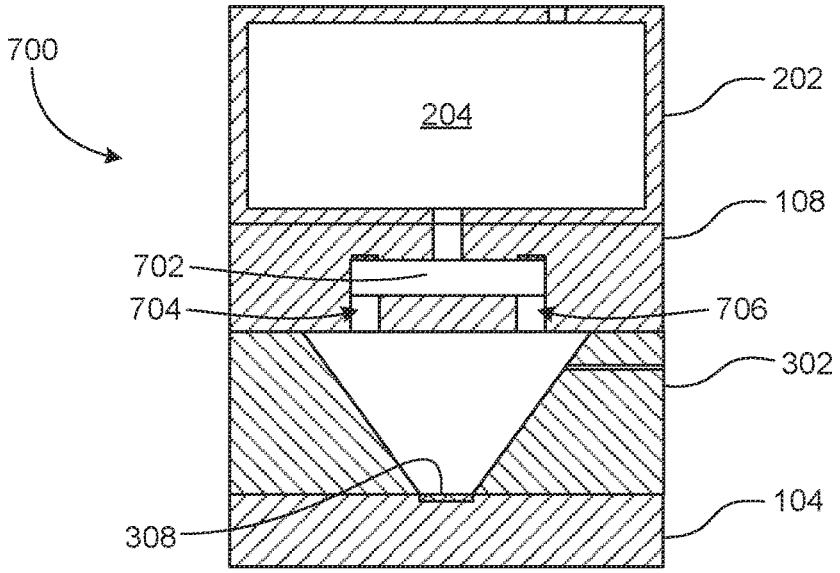
FIG. 7 is a cross-sectional view of an example device with an example funnel between a target medium and a plurality of droplet ejectors.

FIG. 7 shows an example device 700. Features and aspects of the other devices and systems described herein may be used with the device 700 and vice versa. Like reference numerals denote like elements and description of like elements is not repeated here.

The device 700 includes a common channel 702 that feeds a plurality of droplet ejectors 704, 706 formed in a substrate 108. The channel 702 connects a fluid reservoir 202 to the droplet ejectors 704, 706. A funnel 302 may be provided to guide droplets and coalesced liquid to a target region 308 on a target medium 104. If droplet ejector flow capacity is a limiting factor to flow rate, total flow rate may be increased by a plurality of droplet ejectors 704, 706 fed by the same fluid volume 204.

FIGS. 8-13 show example devices having various example configurations of the following structures: fluid reservoir, substrate, droplet ejector, and target medium. Each of these structures may be provided in various quantities and with various fluid connections. The examples provided are not intended to be exhaustive. It should be understood that any number of fluid reservoirs may feed any number of fluids to any number of droplet ejectors formed in any number of substrates held stationary with respect to any number of target media having any number and positioning of target regions. Hence, a droplet of a particular fluid from a particular fluid reservoir may be deposited at a desired target region.

Figure 8:
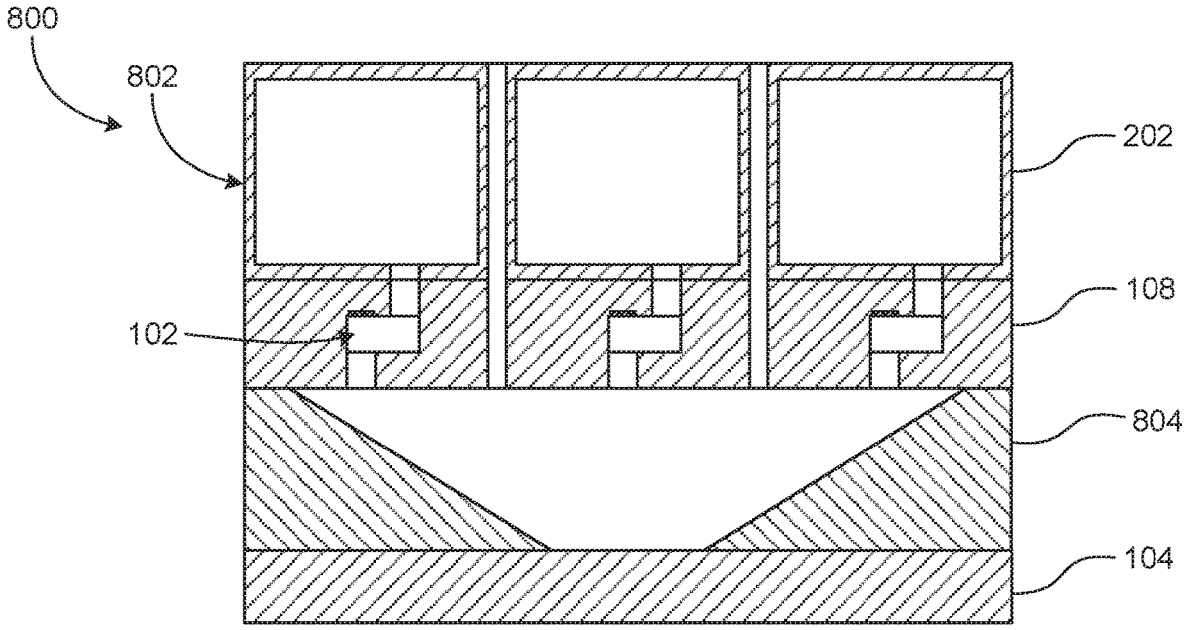
FIG. 8 is a cross-sectional view of an example device with a plurality of droplet ejection units affixed to a target medium.

FIG. 8 shows an example device 800. Features and aspects of the other devices and systems described herein may be used with the device 800 and vice versa. Like reference numerals denote like elements and description of like elements is not repeated here.

The device 800 includes a plurality of droplet ejection units 802. A droplet ejection unit 802 may include a fluid reservoir 202 and a substrate 108 that includes a droplet ejector 102 to receive fluid from the fluid reservoir 202. The fluid reservoir 202 may be affixed to the substrate 108. As such, a plurality of substrates 108 are provided and a particular substrate 108 may connect to a particular fluid reservoir 202. In other examples, a particular fluid reservoir 202 may feed a plurality of droplet ejectors 102 formed in a plurality of substrates 108, as shown for example at 902 in FIG. 9.

The plurality of droplet ejection units 802 may be provided with a shared funnel 804 or other enclosure or frame to guide droplets and coalesced liquid to a common target medium 104. The plurality of droplet ejection units 802 may be affixed to the target medium 104 by the funnel 804 or other structure.

The droplet ejection units 802 may provide different fluids to the same target medium 104. The droplet ejection units 802 may be operated in a sequence conducive to a process performed at the target medium 104. For example, a first droplet ejection unit 802 may eject a buffer to the target medium 104 and a second droplet ejection unit 802 may eject a sample to the target medium 104 at a different time.

Irrespective of whether the same fluid or different fluids are provided to different droplet ejection units 802, use of multiple separate substrates 108 may reduce manufacturing complexity as opposed to a single larger substrate. For example, a modular device having a number of droplet ejection units 802 for a number of fluids may be constructed from a standard droplet ejection unit 802. Further, separate smaller substrates may allow for different functionality to be applied to different substrates and allow for different substrate materials to be used.

Figure 9:
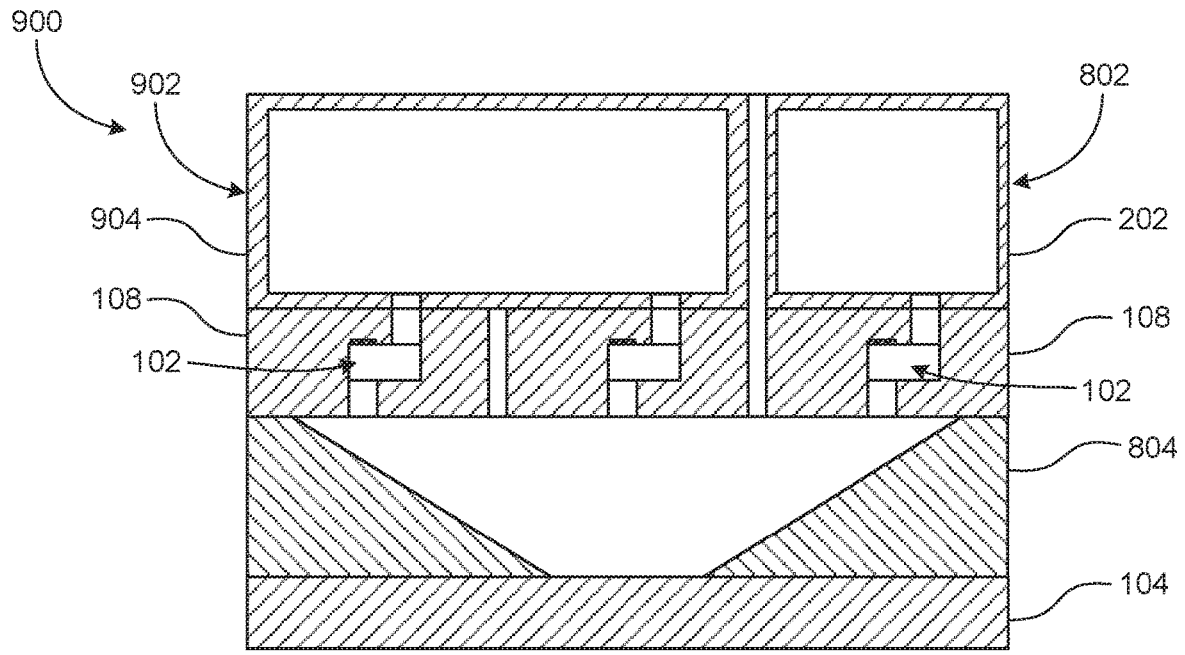
FIG. 9 is a cross-sectional view of an example device with a plurality of droplet ejection units affixed to a target medium and a shared fluid reservoir.

FIG. 9 shows an example device 900. Features and aspects of the other devices and systems described herein may be used with the device 900 and vice versa. Like reference numerals denote like elements and description of like elements is not repeated here.

The device 900 may include a plurality of droplet ejection units 802, 902. A droplet ejection unit 902 may include a fluid reservoir 904 and a plurality of substrates 108. A substrate 108 may include a droplet ejector 102 to receive fluid from the fluid reservoir 904. The fluid reservoir 904 may be connected to droplet ejectors 102 of the plurality of substrates 108, such that different substrates 108 share the same fluid reservoir 904 and thus eject the same fluid.

Figure 10:
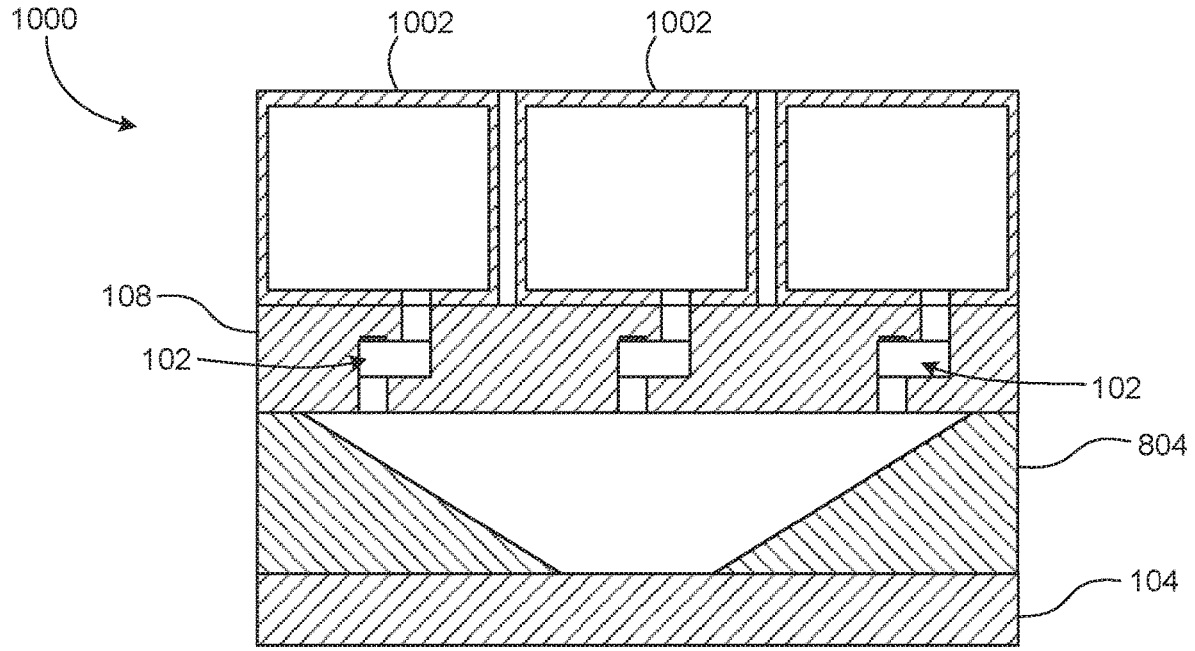
FIG. 10 is a cross-sectional view of an example device with a plurality of fluid reservoirs affixed to a target medium via a common substrate.

FIG. 10 shows an example device 1000. Features and aspects of the other devices and systems described herein may be used with the device 1000 and vice versa. Like reference numerals denote like elements and description of like elements is not repeated here.

The device 1000 includes a substrate 108 that defines a plurality of droplet ejectors 102. The device further includes a plurality of fluid reservoirs 1002 to feed fluid to the plurality of droplet ejectors 102. A first droplet ejector 102 may be connected to a first fluid reservoir 1002, and a second droplet ejector 102 may be connected to a second fluid reservoir 1002 that is different from the first fluid reservoir 1002. As such, different fluids may be provided to different droplet ejectors 102 formed in the same common substrate 108.

Figure 11:
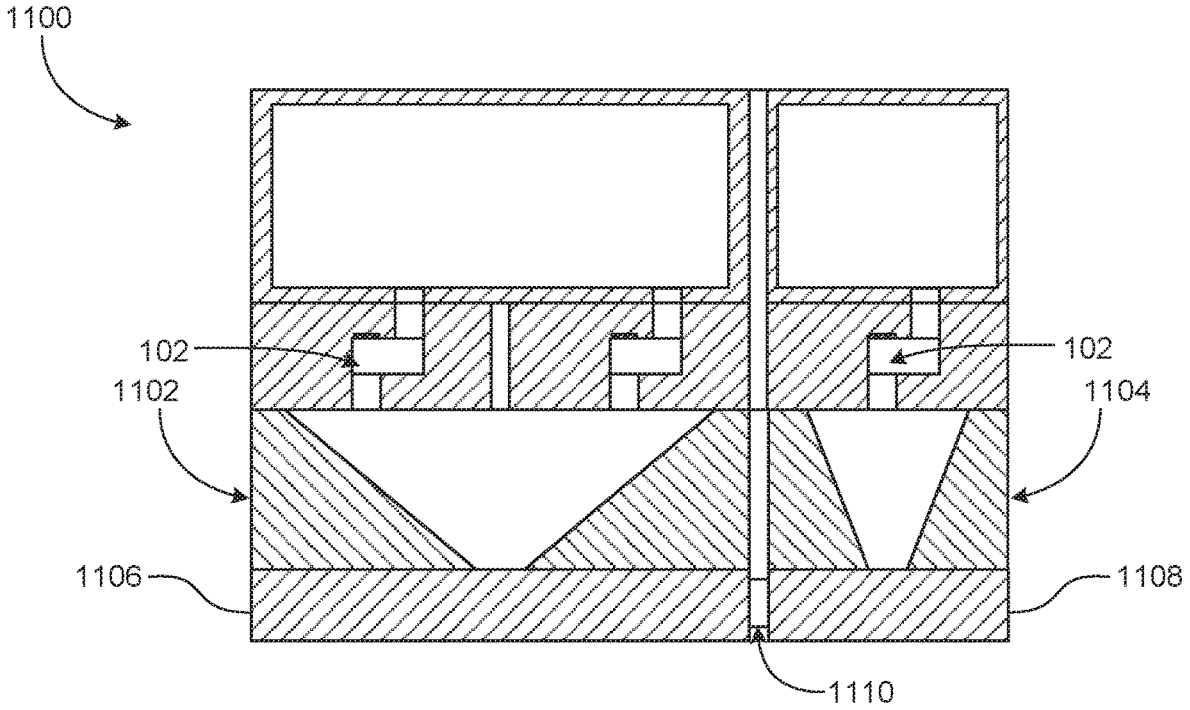
FIG. 11 is a cross-sectional view of an example device with a fluid reservoir affixed to a target medium via separate substrates.

FIG. 11 shows an example device 1100. Features and aspects of the other devices and systems described herein may be used with the device 1100 and vice versa. Like reference numerals denote like elements and description of like elements is not repeated here.

The device 1100 includes a plurality of funnels 1102, 1104 or similar enclosures fed by a plurality of droplet ejectors 102. The funnels 1102, 1104 may be fed by different droplet ejectors 102, which may be fed by different fluid reservoirs.

The funnels 1102, 1104 may feed different target media 1106, 1108 or different target regions of the same target medium. Different target media 1106, 1108 may be fluidically connected by a conduit 1110 or other microfluidic or mesofluidic structure.

The funnels 1102, 1104, target media 1106, 1108, and droplet ejectors 102 may be affixed together to form a consumable device that may be provided as a disposable cartridge.

Figure 12:
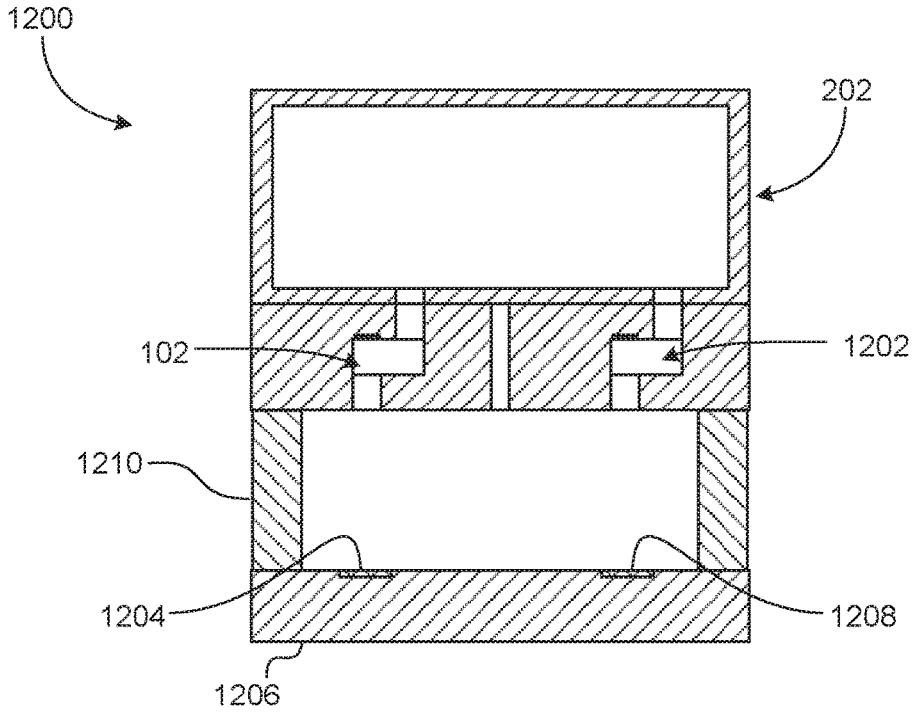
FIG. 12 is a cross-sectional view of an example device with a plurality of droplet ejectors affixed to a target medium having a plurality of target regions.

FIG. 12 shows an example device 1200. Features and aspects of the other devices and systems described herein may be used with the device 1200 and vice versa. Like reference numerals denote like elements and description of like elements is not repeated here.

The device 1200 includes a plurality of droplet ejectors 102, 1202 that may be fed by a common fluid reservoir 202 or, in other examples, separate fluid reservoirs. A first droplet ejector 102 may be aimed towards a first target region 1204 of a target medium 1206. A second droplet may be aimed towards a second target region 1208 of the same target medium 1206. Accordingly, different droplets may be used to create different reactions on the same target medium 1206.

The droplet ejectors 102, 1202 may be affixed to the target medium by a frame 1210 or similar structure.

Figure 13:
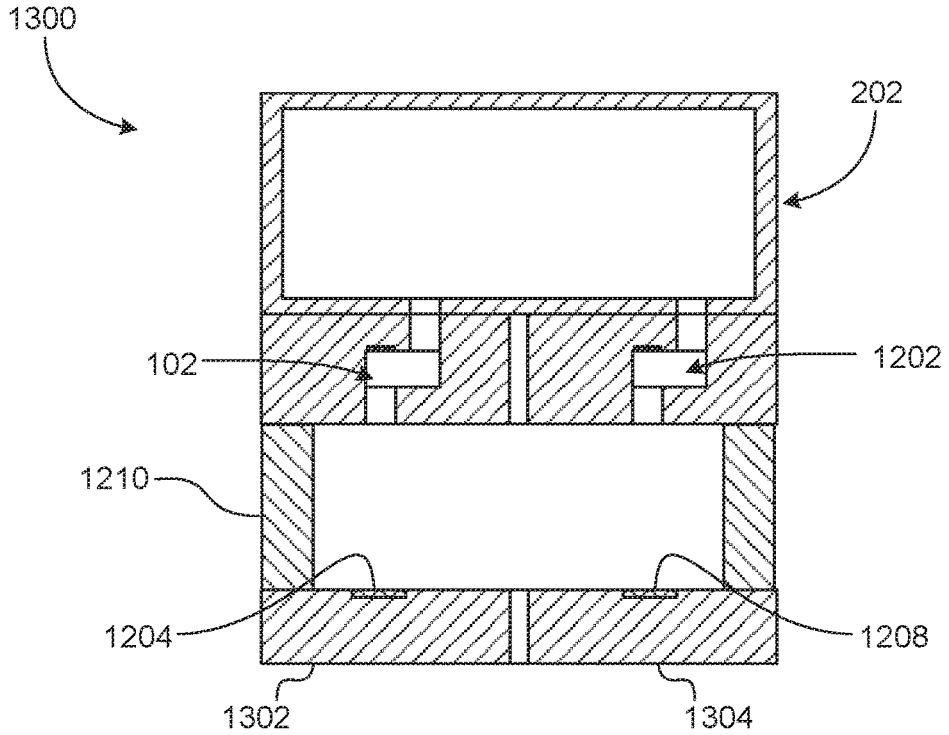
FIG. 13 is a cross-sectional view of an example device with a plurality of droplet ejectors affixed to target media having a plurality of target regions.

FIG. 13 shows an example device 1300. Features and aspects of the other devices and systems described herein may be used with the device 1300 and vice versa. Like reference numerals denote like elements and description of like elements is not repeated here.

The device 1300 includes a plurality of droplet ejectors 102, 1202 that may be fed by a common fluid reservoir 202 or, in other examples, separate fluid reservoirs. A first droplet ejector 102 may be aimed towards a first target region 1204 of a first target medium 1302. A second droplet may be aimed towards a second target region 1208 of a second target medium 1304 that is different and separate from the first target medium 1302.

The droplet ejectors 102, 1202 may be affixed to the target media 1302, 1304 by a frame 1210 or similar structure.

Figure 14:
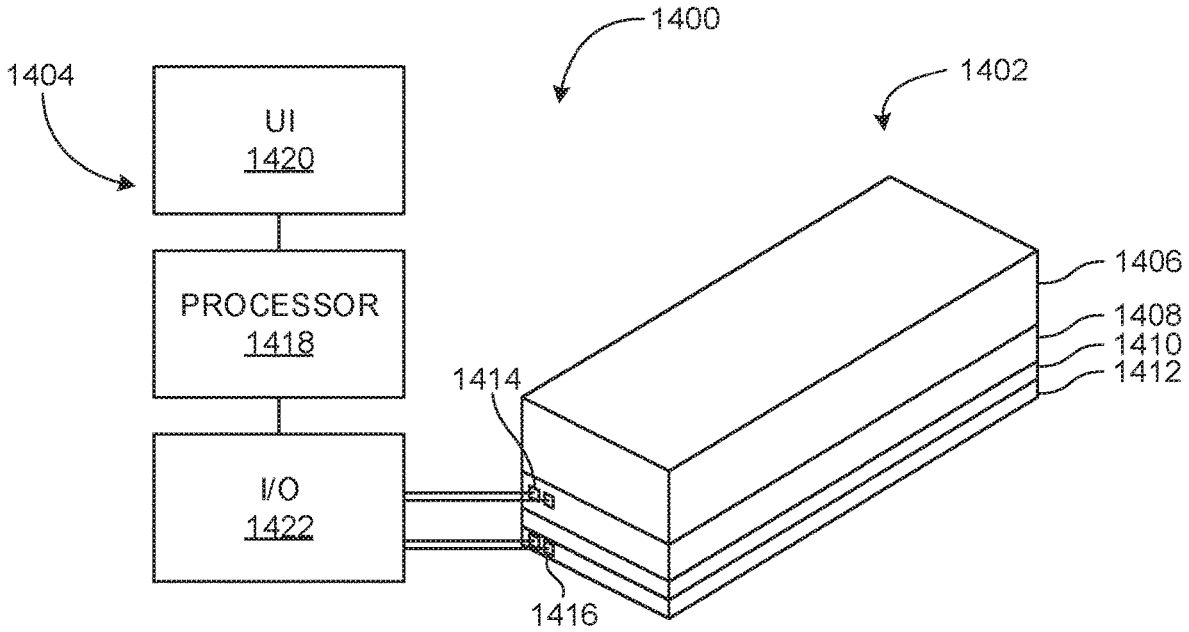
FIG. 14 is a schematic view of an example system including an example control device and an example cartridge including a target medium affixed to a droplet ejector.

FIG. 14 shows an example system 1400. Features and aspects of the other devices and systems described herein may be used with the system 1400 and vice versa. Like reference numerals denote like elements and description of like elements is not repeated here.

The system includes a cartridge 1402 and a control device 1404. The cartridge 1402 may be a disposable cartridge that may be discarded after use.

The disposable cartridge 1402 may be similar or identical to any of the devices described elsewhere herein. The disposable cartridge 1402 may include a fluid reservoir 1406, a substrate 1408, a frame 1410, and a target medium 1412. The fluid reservoir 1406 may feed fluid to a droplet ejector at the substrate 1408, which may eject droplets of fluid to the target medium 1412. The frame 1410 may permanently connect the substrate 1408 to the target medium 1412. The target medium 1412 may be immovably held with respect to the droplet ejector of the substrate 1408 by the frame 1410. The frame 1410 may include a funnel, enclosure, or similar structure. As depicted, in this example, the frame 1410 encloses a volume between the substrate 1408 and the target medium 1412.

A terminal 1414 may be provided to the substrate 1408 to connect a jet element of the droplet ejector to the control device 1404. The control device 1404 may provide a drive signal to the terminal 1414 to drive the droplet ejector at the substrate 1408 to eject fluid droplets to the target medium 1412.

A terminal 1416 may be provided to the target medium 1412 to connect a sensor at the target medium 1412 to the control device 1404. The control device 1404 may receive from the terminal 1416 a measurement signal indicative of a process carried out by the disposable cartridge 1402.

The control device 1404 may include a processor 1418, a user interface 1420, and an input/output interface 1422.

The user interface 1420 may be connected to the processor 1418 and may include a display, touchscreen, keyboard, or similar to provide output to a user and receive input from the user.

The input/output interface 1422 may be connected to the processor 1418 and provides signal communications between the disposable cartridge 1402 and the processor 1418. The input/output interface 1422 may receive a removeable connection to the terminals 1414, 1416 of the disposable cartridge 1402.

The processor 1418 may include a central processing unit (CPU), a microcontroller, a microprocessor, a processing core, a field-programmable gate array (FPGA), and/or similar device capable of executing instructions. The processor 1418 may cooperate with a non-transitory machine-readable medium that may be an electronic, magnetic, optical, and/or other physical storage device that encodes executable instructions. The machine-readable medium may include, for example, random access memory (RAM), read-only memory (ROM), electrically-erasable programmable read-only memory (EEPROM), flash memory, a storage drive, an optical disc, and/or similar.

The processor 1418 may control the disposable cartridge 1402 to carry out its function by controlling a number of droplet ejectors to activate, a frequency of droplet ejection of a droplet ejector, a combination of such, or similar. The processor 1418 may receive output of the process carried out at the disposable cartridge 1402 as a signal that may be used to further control the process at the disposable cartridge 1402 or that may be outputted to the user at the user interface 1420.

The control device 1404 may control the functionality of a variety of different disposable cartridges 1402. The control device 1404 may control more than one disposable cartridge 1402 at the same time.

The control device 1404 may include a mechanical feature to removably mechanically receive a disposable cartridge 1402 by way of a mating mechanical feature at the disposable cartridge 1402.

It should apparent from the above that a droplet ejector and target medium may be held stationary with respect to one another when providing fluid delivery through the droplet ejector, so as to reduce or eliminate the need for a relative motion mechanism and related motion controller. An enclosure, funnel, or similar structure may be situated between a droplet ejector and a target medium. A funnel may be used to guide droplets and direct flow of fluid to a target region of a target medium. A single-use or consumable cartridge may carry both a droplet ejector and a target medium. The devices and systems discussed herein may be flexible, in that they may enable delivery of fluids with diverse physical properties, and may be scalable in the number of fluids and fluid volumes that may be provided.

It should be recognized that features and aspects of the various examples provided above can be combined into further examples that also fall within the scope of the present disclosure. In addition, the figures are not to scale and may have size and shape exaggerated for illustrative purposes.

The invention claimed is:

1. A device comprising:

a first droplet ejector including a nozzle to eject droplets;

a second droplet ejector including a nozzle to eject droplets;

a target medium to receive the droplets of the fluid, the target medium separated from the first droplet ejector by a gap to be traversed by the droplets; and a frame affixing the target medium to the first droplet ejector, wherein the target medium is immovably held with respect to the first droplet ejector, and wherein the target medium is positioned with respect to the second droplet ejector to provide a direct flight path of droplets from the second droplet ejector to a target region on the tar et medium.

2. The device of claim 1, further comprising an enclosure disposed between the nozzle of the droplet ejector and the target medium, the enclosure defining an internal droplet volume to contain the droplets ejected by the droplet ejector as the droplets traverse the gap.

3. The device of claim 1, further comprising a funnel disposed between the nozzle of the droplet ejector and the target medium.

4. The device of claim 3, wherein the funnel is positioned with respect to the first droplet ejector to guide flow of a liquid to the target region on the target medium, the liquid created by coalescence of droplets ejected by the first droplet ejector.

5. The device of claim 1, further comprising a fluid volume to supply the fluid to the first droplet ejector, the second droplet ejector or both; or a first fluid volume and a second fluid volume to supply fluid to the first droplet ejector and the second droplet ejector, respectively.

6. The device of claim 5, further comprising the fluid preloaded in the fluid volume or preloaded in first fluid volume and the second fluid volume.

7. The device of claim 1, wherein the target medium includes an ac microfluidic component.

8. The device of claim 1, wherein the first droplet ejector, second droplet ejector, target medium, and frame are integrated as a disposable cartridge.

9. A disposable cartridge comprising:

a droplet ejector including a plurality of droplet ejectors;

a plurality of fluid volumes to feed fluid to the plurality of droplet ejectors, wherein the fluid volumes are to feed different fluids to different droplet ejectors of the plurality of droplet ejectors;

a target medium permanently connected to a droplet ejector of the plurality of droplet ejectors, the target medium to receive droplets of a fluid from the droplet ejector, the target medium separated from the droplet ejector by a gap to be traversed by the droplets; and wherein the target medium is immovably held with respect to the droplet ejector.

10. The disposable cartridge of claim 9, further comprising a funnel disposed between the nozzle of the droplet ejector and the target medium.

11. The disposable cartridge of claim 10, wherein the droplet ejector delivers droplets to a surface of the funnel prior to being delivered to the target medium, and wherein a second droplet ejector provides a direct flight path of droplets to the target medium.

12. The disposable cartridge of claim 9, further comprising a second funnel disposed between a droplet ejector of the plurality of droplet ejectors and the target medium.

13. The disposable cartridge of claim 9, wherein the plurality of droplet ejectors includes a third droplet elector.

14. A device comprising:

a substrate carrying a first droplet ejector to eject droplets and a second droplet ejector to eject droplets of fluid;

a fluid reservoir to provide the fluid to the first and second droplet ejectors, or a first fluid reservoir and a second fluid reservoir to delivery fluid to the first and second droplet ejectors, respectively;

a target medium to receive the droplets from the first and second droplet ejectors, the target medium separated from the droplet ejector by a gap to be traversed by the droplets; and a funnel positioned between the target medium and the substrate, the funnel to guide the droplets and liquid created by coalescence of the droplets ejected by the first droplet ejector, the second droplet ejector, or both towards a target region of the target medium.

15. The device of claim 14, wherein the first droplet ejector and the second droplet ejector both delivery droplets to the funnel where liquid created by coalescence is guided toward the target medium.

16. The device of claim 14, wherein the first droplet ejector delivers droplets to the funnel where liquid created by coalescence is guided toward the target medium, and wherein the second droplet ejector provides a direct flight path of droplets from the second droplet ejector to a the target medium.

17. The device of claim 14, comprising the first fluid reservoir and the second fluid reservoir, wherein a first fluid of the first fluid reservoir is different than a second fluid of the second fluid reservoir.

18. The device of claim 14, comprising the first fluid reservoir and the second fluid reservoir, wherein a first fluid of the first fluid reservoir is the same as a second fluid of the second fluid reservoir.

19. The device of claim 14, wherein the fluid reservoir delivers the same fluid to both the first droplet ejector and the second droplet ejector.

* * * * *